US011804164B2

(12) United States Patent
Lim et al.

(10) Patent No.: US 11,804,164 B2
(45) Date of Patent: Oct. 31, 2023

(54) DISPLAY DEVICE AND DRIVING METHOD THEREOF

(71) Applicant: Samsung Display Co., LTD., Yongin-si (KR)

(72) Inventors: Hyun Ho Lim, Hwaseong-si (KR); Min Ha Keum, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/585,397

(22) Filed: Jan. 26, 2022

(65) Prior Publication Data

US 2022/0358872 A1 Nov. 10, 2022

(30) Foreign Application Priority Data

May 4, 2021 (KR) ..... 10-2021-0057926

(51) Int. Cl.
*G09G 3/20* (2006.01)

(52) U.S. Cl.
CPC ... *G09G 3/2092* (2013.01); *G09G 2310/0267* (2013.01); *G09G 2310/0275* (2013.01); *G09G 2320/0233* (2013.01); *G09G 2330/021* (2013.01)

(58) Field of Classification Search
CPC ..... G09G 3/2092; G09G 2310/0267; G09G 2310/0275; G09G 2320/0233; G09G 2330/021; G09G 3/20; G09G 2330/028; G09G 2340/0435; G09G 2360/16; G09G 3/2074; G09G 5/10; G09G 2310/0264
See application file for complete search history.

(56) References Cited

U.S. PATENT DOCUMENTS

| | | | | |
|---|---|---|---|---|
| 6,236,394 | B1 * | 5/2001 | Ikeda | G09G 3/3696 345/95 |
| 9,082,366 | B2 | 7/2015 | Han et al. | |
| 10,067,595 | B2 | 9/2018 | Jeong et al. | |
| 10,210,807 | B2 | 2/2019 | Yim et al. | |
| 10,810,942 | B2 | 10/2020 | Pyo et al. | |
| 2002/0196208 | A1 * | 12/2002 | Nanno | G09G 3/3659 345/55 |
| 2005/0073867 | A1 * | 4/2005 | Byun | H02M 3/33561 363/84 |
| 2006/0022992 | A1 * | 2/2006 | Tsuji | G09G 3/3406 345/589 |

(Continued)

FOREIGN PATENT DOCUMENTS

| | | |
|---|---|---|
| KR | 10-2013-0025057 | 3/2013 |
| KR | 10-2017-0017540 | 2/2017 |

(Continued)

*Primary Examiner* — Jose R Soto Lopez
(74) *Attorney, Agent, or Firm* — H.C. Park & Associates, PLC

(57) ABSTRACT

A display device includes: a display unit including a plurality of pixels to display an image; a first power supply to generate a first power voltage; a second power supply to generate a second power voltage; and a signal controller to control the first power supply to supply the first power voltage to the display unit in response to at least one control signal associated with luminance of the image, and to control the second power supply to stop supplying the second power voltage after the first power voltage starts to be supplied.

19 Claims, 8 Drawing Sheets

(56) References Cited

U.S. PATENT DOCUMENTS

2006/0050042 A1* 3/2006 Yi ..... H02M 1/15 345/98
2009/0109142 A1* 4/2009 Takahara ..... G09G 3/006 345/76
2009/0109147 A1* 4/2009 Park ..... G09G 3/3233 345/76
2009/0195484 A1* 8/2009 Lee ..... G09G 3/3225 345/76
2009/0289932 A1* 11/2009 Nishi ..... G09G 3/3696 345/212
2010/0013867 A1* 1/2010 Kim ..... G09G 3/3233 313/504
2010/0118011 A1* 5/2010 Yang ..... G09G 3/3696 345/94
2011/0018787 A1* 1/2011 Nakamura ..... G09G 3/3291 345/76
2011/0273109 A1* 11/2011 Park ..... G09G 3/3225 315/291
2012/0044273 A1* 2/2012 Park ..... G09G 3/3208 345/211
2012/0223926 A1* 9/2012 Morii ..... G09G 3/3696 345/96
2012/0293481 A1* 11/2012 Chaji ..... G06F 3/038 345/212
2014/0118416 A1* 5/2014 Chen ..... G09G 3/38 345/77
2014/0159804 A1* 6/2014 Yoon ..... H02M 3/07 327/536
2015/0253840 A1* 9/2015 Hong ..... G06F 1/3218 307/130
2016/0125799 A1* 5/2016 Shin ..... G09G 3/3208 345/212
2016/0179179 A1* 6/2016 An ..... G06F 1/263 345/212
2016/0180771 A1* 6/2016 Jeong ..... G09G 3/3258 345/82
2016/0180815 A1* 6/2016 Pyo ..... G09G 3/3225 345/82
2016/0240146 A1* 8/2016 Lee ..... G09G 3/2003
2017/0132975 A1* 5/2017 Park ..... G09G 3/3266
2017/0186375 A1* 6/2017 Jung ..... G09G 3/3233
2017/0330518 A1* 11/2017 Lee ..... G09G 3/3233
2017/0345381 A1* 11/2017 Hou ..... G09G 3/006
2018/0061322 A1* 3/2018 Yim ..... G06F 1/3296
2018/0090064 A1* 3/2018 Liu ..... G09G 3/3208
2019/0304372 A1* 10/2019 Pyo ..... H10K 59/1213
2019/0311678 A1* 10/2019 Lee ..... G09G 3/3258
2019/0340965 A1* 11/2019 Chang ..... G09G 3/006
2020/0372853 A1* 11/2020 Park ..... G09G 3/32
2021/0020103 A1* 1/2021 Yamato ..... G09G 3/3241
2021/0248975 A1* 8/2021 Zhai ..... G09G 5/10
2021/0304651 A1* 9/2021 Huang ..... G05F 1/56
2021/0389150 A1* 12/2021 Maki ..... G06V 20/56

FOREIGN PATENT DOCUMENTS

KR 10-2018-0025508 3/2018
KR 10-2019-0114062 10/2019

* cited by examiner

DISPLAY DEVICE AND DRIVING METHOD THEREOF

CROSS-REFERENCE TO RELATED APPLICATION

This application claims priority from and the benefit of Korean Patent Application No. 10-2021-0057926, filed on May 4, 2021, which is hereby incorporated by reference for all purposes as if fully set forth herein.

BACKGROUND

Field

Embodiments of the invention relate generally to a display device, and more specifically, to a display device including a plurality of pixels and a method of driving the same.

Discussion of the Background

A display device includes a display panel including a plurality of pixels and a driver integrated circuit (IC) for applying driving signals to the pixels. The pixels may receive a power voltage to display images based on the driving signals. The power voltage may be converted by a DC-DC converter and is then supplied to the pixels.

A mobile driver IC used in mobile devices such as smart phones generally includes a source driver IC and a gate driver IC, and recently, various driver ICs and timing controllers are integrated into a one-chip unit.

The above information disclosed in this Background section is only for understanding of the background of the inventive concepts, and, therefore, it may contain information that does not constitute prior art.

SUMMARY

Applicant realized that conventional display panels require a relatively low current load from a power supply, such as a DC-DC converter, when displaying a low luminance image and the relatively low current load causes the power supply to have relatively low power efficiency.

Display devices constructed according to principles and illustrative embodiments of the invention and methods of driving the same are capable of using power with relatively high efficiency, such as when the display device is displaying a low luminance image. For example, display devices constructed according to the principles and embodiments of the invention may change the power voltage being supplied to pixels based on at least one control signal indicative of the luminance of the image. Accordingly, power consumption may be reduced.

Additional features of the inventive concepts will be set forth in the description which follows, and in part will be apparent from the description, or may be learned by practice of the inventive concepts.

According to one aspect of the invention, a display device includes: a display unit including a plurality of pixels to display an image; a first power supply to generate a first power voltage; a second power supply to generate a second power voltage; and a signal controller to control the first power supply to supply the first power voltage to the display unit in response to at least one control signal associated with luminance of the image, and to control the second power supply to stop supplying the second power voltage after the first power voltage starts to be supplied.

The control signal may include a luminance setting value, and the signal controller may be configured to receive the luminance setting value from an application processor and to control the first power supply to supply the first power voltage in response to the luminance setting value being less than a first threshold value.

The signal controller may be configured to control the second power supply to supply the second power voltage to the display unit in response to the control signal when the first power voltage is supplied to the display unit, and to control the first power supply to stop supplying the first power voltage after the second power voltage starts to be supplied.

The control signal may include a luminance setting value, and the signal controller may be configured to receive the luminance setting value from an application processor and to control the second power supply to supply the second power voltage in response to the luminance setting value being greater than a second threshold value.

The at least one control signal may include first control signals generated in consecutive first frame periods, and the signal controller may be configured to control the first power supply to supply the first power voltage to the display unit in response to the first control signals being less than a first threshold value.

The at least one control signal may include second control signals generated in consecutive second frame periods in which the first power voltage is supplied to the display unit, and the signal controller may be configured to control the second power supply to supply the second power voltage to the display unit in response to the second control signals being greater than a second threshold value, and to control the first power supply to stop supplying the first power voltage after the second power voltage starts to be supplied.

The display device may include a current sensor to generate a current sensing value by sensing at least one of current flowing to the display unit from the first power supply and current flowing to the display unit from the second power supply. The signal controller may be configured to receive the current sensing value as the control signal in at least one frame period, and to control the first power supply to supply the first power voltage in response to the current sensing value being less than a first threshold value.

The first power supply may include a charge pump, and the second power supply may include a DC-DC converter.

The display device may further include a data driver to generate data signals based on image data and to output the data signals to the display unit through a plurality of data lines connected to the pixels. The signal controller, the first power supply, and the data driver may be integrated into an IC chip.

The first power voltage may have a level lower than a level of the second power voltage, and the signal controller may be configured to control the first power supply to supply the first power voltage to the display unit in response to the control signal when the second power voltage is supplied to the display unit.

The signal controller may be configured to control the second power supply to maintain the second power voltage supplied to the display unit for a predetermined period of time after the first power voltage starts to be supplied, and to stop supplying the second power voltage after the predetermined period of time elapses.

According to another aspect of the invention, a method of driving a display device having a display unit to display an image includes the steps of: receiving at least one control signal associated with luminance of the image; supplying a first power voltage to the display unit in response to the control signal when a second power voltage is supplied to the display unit; continuing to supply the second power voltage to the display unit for a first period of time after the first power voltage starts to be supplied; and stopping supplying the second power voltage after the first period of time elapses.

The control signal may include a luminance setting value, the luminance setting value may be received from an application, and the step of supplying the first power voltage may include supplying the first power voltage to the display unit in response to the luminance setting value being less than a first threshold value.

The method may further include the steps of: supplying the second power voltage to the display unit in response to the control signal when the first power voltage is supplied to the display unit; maintaining the first power voltage supplied to the display unit for a second period of time after the second power voltage starts to be supplied; and stopping supplying the first power voltage after the second period of time elapses.

The control signal may include a luminance setting value, the luminance setting value may be received from an application processor, and the step of supplying the second power voltage may include supplying the second power voltage to the display unit in response to the luminance setting value being greater than a second threshold value.

The at least one control signal may include first control signals generated in consecutive first frame periods, and the step of supplying the first power voltage may include supplying the first power voltage to the display unit in response to the first control signals being less than a first threshold value.

The at least one control signal may include second control signals generated in consecutive second frame periods in which the first power voltage is supplied to the display unit. The method may further include the steps of: supplying the second power voltage to the display unit in response to the second control signals being greater than a second threshold value; maintaining the first power voltage supplied to the display unit for a second period of time after the second power voltage starts to be supplied; and stopping supplying the first power voltage after the second period of time elapses.

The method may further include the step of generating a current sensing value by sensing current for the first power voltage supplied to the display unit and sensing current for the second power voltage supplied to the display unit. The at least one control signal may include the current sensing value generated in at least one frame period, and the step of supplying the first power voltage may include supplying the first power voltage to the display unit in response to the current sensing value being less than a threshold value.

The first power voltage may have a level lower than a level of the second power voltage; and the step of supplying the first power voltage may include supplying the first power voltage to the display unit in response to the control signal being less than a threshold voltage.

According to still another aspect of the invention, a display device includes: a display unit disposed on a substrate and including a plurality of pixels to display an image; a scan driver disposed on the substrate to output a scan signal to a plurality of scan lines connected to the pixels; a data driver to generate data signals based on image data received from an application processor and to output the data signals to the display unit through a plurality of data lines connected to the pixels; a charge pump to generate a first power voltage for the display unit; a DC-DC converter to generate a second power voltage for the display unit; and a signal controller to control the charge pump to supply the first power voltage to the display unit in response to at least one control signal associated with luminance of the image, and to control the DC-DC converter to stop supplying the second power voltage after the first power voltage starts to be supplied. The data driver, the charge pump, and the signal controller are disposed in an IC chip.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION OF THE EMBODIMENTS

Figure 1:
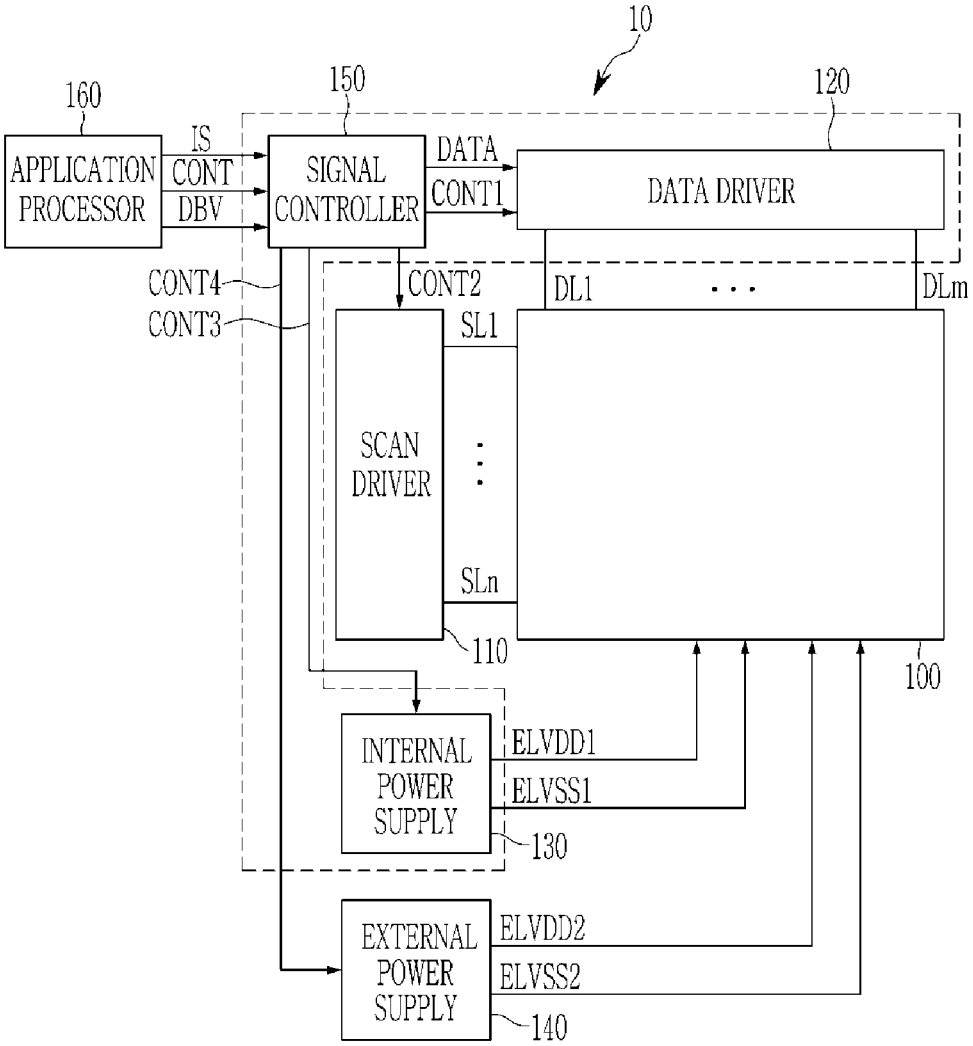
FIG. 1 is a block diagram of an embodiment of a display device constructed according to the principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of an embodiment of a display device constructed according to the principles of the invention.

The display device 10 includes a display unit 100, a scan driver 110, a data driver 120, a first power supply (or an internal power supply) 130, a second power supply (or an external power supply) 140, and a signal controller 150. The display device 10 may be connected to an application processor 160 or may include the application processor 160. Constituent elements shown in FIG. 1 are not essential in realization of the display device, so the display device 10 may include a greater or a smaller number of constituent elements than the constituent elements of FIG. 1. For example, while the two power supplies are shown as separate components, they may be integrated into a single component.

The display unit 100 includes a plurality of pixels connected to a plurality of scan lines SL1 to SLn and a plurality of data lines DL1 to DLm. The pixels, that receive a scan signal through each scan line connected thereto, respectively emit light according to data signals transmitted through the data lines DL1 to DLm using power voltages ELVDD1 and ELVSS1 and/or power voltages ELVDD2 and ELVSS2, so the display unit 100 may display images.

The scan lines SL1 to SLn substantially extend in a row direction and are substantially parallel to each other. The data lines DL1 to DLm substantially extend in a column direction and are substantially parallel to each other. The scan lines SL1 to SLn and the data lines DL1 to DLm may be disposed substantially parallel to each other according to the form (or shape) of the display unit 100 and a specific configuration of respective lines, but embodiments are not limited to and specific configuration.

The pixels receive power voltages ELVDD1, ELVDD2, ELVSS1, and ELVSS2 through voltage supply lines from the first power supply 130 and/or the second power supply 140.

The data lines DL1 to DLm and the voltage supply lines for the power voltages ELVDD1, ELVDD2, ELVSS1, and ELVSS2 may be positioned on the same layer on the substrate of the display unit 100. The scan lines SL1 to SLn, the data lines DL1 to DLm, and the voltage supply lines for the power voltage ELVDD1, ELVDD2, ELVSS1, and ELVSS2 may include the same material or different materials, and they may be positioned on the same layer or different layers on the substrate.

The scan driver 110 is connected to the display unit 100 through the scan lines SL1 to SLn. The scan driver 110 is configured to generate and apply scan signals to the scan lines SL1 to SLn, respectively, in response to a control signal CONT2. The control signal CONT2 is an operation control signal for the scan driver 110, which is generated and transmitted by the signal controller 150.

The scan driver 110 may be positioned on the same substrate as the display unit 100.

The data driver 120 is connected to the respective pixels of the display unit 100 through the data lines DL1 to DLm. The data driver 120 receives the image data signal DATA and transmits data signals to the data lines DL1 to DLm based on the image data signal DATA in response to a control signal CONT1. The control signal CONT1 is an operation control signal for the data driver 120 generated and transmitted by the signal controller 150.

The data driver 120 selects gray (or grayscale) voltages based on the image data signal DATA and applies the gray voltages to the data lines DL1 to DLm as the data signals. For example, the data driver 120 samples and maintains the input image data signal DATA in response to the control signal CONT1, and transmits the data signals to the data lines DL1 to DLm. The data driver 120 may, while a low-level scan signal is applied, apply the data signals with a predetermined voltage range to the data lines DL1 to DLm.

The signal controller 150 receives an image signal IS and an input control signal CONT to control its operations from the application processor 160. The image signal IS may include luminance information indicative of the gray level of the respective pixels of the display unit 100.

The input control signal CONT transmitted to the signal controller 150 includes a vertical synchronization signal, a horizontal synchronizing signal, a main clock signal, a data enable signal, and a tearing effect TE signal.

The signal controller 150 generates the control signals CONT1, CONT2, CONT3, and CONT4 and the image data signal DATA according to the image signal IS, the horizontal synchronizing signal, the vertical synchronization signal, the main clock signal, the data enable signal, and the TE signal.

The signal controller 150 is configured to image-processes the image signal IS according to operating conditions of the display unit 100 and the data driver 120 based on the input image signal IS and the input control signal CONT. In detail, the signal controller 150 may generate the image data signal DATA by applying image processing such as gamma correction or luminance compensation to the image signal IS.

For example, the signal controller 150 generates a control signal CONT1 to control an operation of the data driver 120, and transmits the same together with the image data signal DATA having undergone the image processing to the data driver 120. The signal controller 150 transmits the control signal CONT2 for controlling an operation of the scan driver 110 to the scan driver 110.

The signal controller 150 receives, from the application processor 160 a luminance setting value DBV, which may be associated with luminance information, such as being indicative of the luminance of the image to be displayed by the display unit 100. The luminance setting value DBV may be automatically set according to peripheral luminance around the display device 10 or may be randomly set by a user. The luminance setting value DBV may be dimming information determined by the image signal IS. For example, the luminance setting value DBV may express a maximum luminance value displayed by the display unit 100.

The signal controller 150 may control the driving of the first power supply 130 and the second power supply 140 according to a power control signal indicative of the luminance of the image displayed and/or to be displayed by the display unit 100, which is in the form of the luminance setting value DBV. The first power supply 130 and the second power supply 140 may supply the power voltages ELVDD1, ELVDD2, ELVSS1, and ELVSS2 for driving the respective pixels. For example, the signal controller 150 transmits the control signal CONT3 to the first power supply 130 so that the first power supply 130 may transmit the power voltages ELVDD1 and ELVSS1 to the display unit 100. The signal controller 150 transmits the control signal CONT4 to the second power supply 140 so that the second power supply 140 may transmit the power voltages ELVDD2 and ELVSS2 to the display unit 100. The first power supply 130 and the second power supply 140 may be connected to the voltage supply lines formed on the display unit 100. The first power supply 130 and the second power supply 140 may generate an additional voltage for driving the pixel and may supply the same.

The power voltage ELVDD1 supplied by the first power supply 130 and the power voltage ELVDD2 supplied by the second power supply 140 may have substantially the same voltage level. In an embodiment, the voltage level of the power voltage ELVDD1 may be lower than the voltage level of the power voltage ELVDD2. In this case, when displaying a low-luminance image, the lower power voltage ELVDD1 is applied, so there is the effect of displaying the low-luminance image with lower luminance.

The power voltage ELVSS1 supplied by the first power supply 130 and the power voltage ELVSS2 supplied by the second power supply 140 may have substantially the same voltage level. The power voltages ELVSS1 and ELVSS2 may be ground voltages and/or reference voltages. In an embodiment, the voltage level of the power voltage ELVSS1 may be higher than the voltage level of the power voltage ELVSS2.

The data driver 120, the signal controller 150, and the first power supply 130 may be configured with an IC chip, such as a driver IC indicated by the dotted line of FIG. 1. The second power supply 140 may be configured with an additional IC chip. The first power supply 130 may include a charge pump. The second power supply 140 may include a DC-DC converter.

Efficiencies of power consumption of the first power supply 130 and the second power supply 140 will now be described with reference to FIG. 2.

Figure 2:
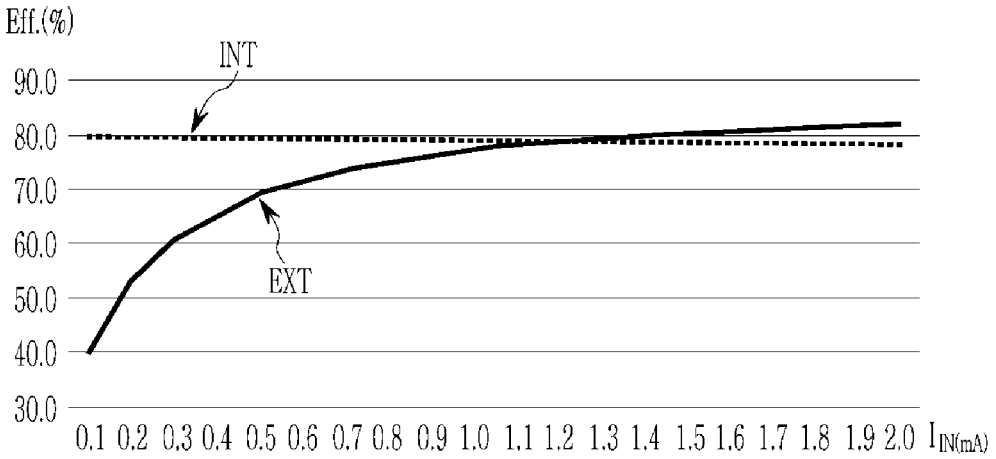
FIG. 2 is a graph of power efficiencies of the power supplies of FIG. 1 according to current load.

FIG. 2 is a graph of power efficiencies of the power supplies of FIG. 1 according to current load.

Referring to FIGS. 1 and 2, the first power supply 130 such as a charge pump may have efficiency INT greater than efficiency EXT of the second power supply 140 such as a DC-DC converter in a range (e.g., a current range required to display a low-luminance image in a display device mounted on a mobile device) of a current load $I_{IN}$ from about 0.1 mA to about 1.2 mA.

The efficiency EXT of the second power supply 140 is greater than the efficiency INT of the first power supply 130 in a range (e.g., a current range required to display a high-luminance image in a display device mounted on a mobile device) of the current load $I_{IN}$ equal to or greater than about 1.2 mA.

Therefore, power consumption may be reduced by selecting one of the first power supply 130 and the second power supply 130 in response to the luminance setting value DBV indicative of the luminance of an image to be displayed by the display unit 100 and by supplying a power voltage to the display unit 100 using the selected power supply.

An illustrative method for driving a display device according to an embodiment will now be described with reference to FIG. 3 to FIG. 6.

Figure 3:
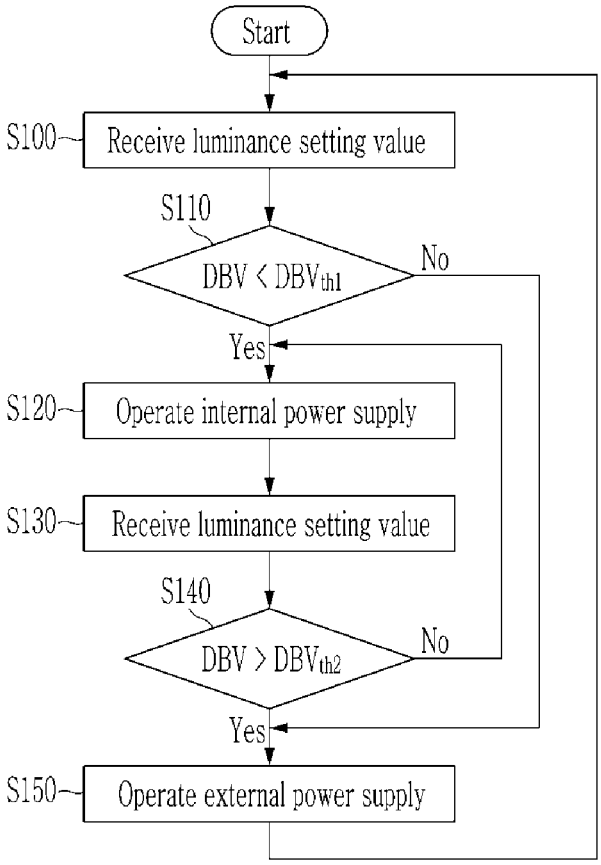
FIG. 3 is a flowchart of an embodiment of a method of driving a display device according to the principles of the invention.

FIG. 3 is a flowchart of an embodiment of a method of driving a display device according to the principles of the invention.

Referring to FIGS. 1 and 3, the signal controller 150 receives a luminance setting value DBV from the application processor 160 (S100).

The signal controller 150 determines whether the luminance setting value DBV is less than a first threshold value $DBV_{th1}$ (S110).

When the luminance setting value DBV is less than the first threshold value $DBV_{th1}$, the signal controller 150 controls an internal power supply, such as the first power supply 130, to apply the power voltages ELVDD1 and ELVSS1 to the display unit 100 (S120). The signal controller 150 may output a control signal CONT3 to the first power supply 130, and the first power supply 130 may output the power voltages ELVDD1 and ELVSS1 to the display unit 100 in response to the control signal CONT3.

When a predetermined time elapses from the time when the first power supply 130 outputs the power voltages ELVDD1 and ELVSS1, the signal controller 150 controls an external power supply, such as the second power supply 140, to stop applying the power voltages ELVDD2 and ELVSS2 to the display unit 100.

In this instance, applying of the power voltages ELVDD1 and ELVSS1 by the first power supply 130 and stopping applying of the power voltages ELVDD2 and ELVSS2 by the second power supply 140 may be performed within the same frame.

The power supply for applying the power voltage may be changed per frame (or a frame period).

Therefore, the signal controller 150 receives the luminance setting value DBV of the next frame from the application processor 160 (S130).

The signal controller 150 determines whether the luminance setting value DBV of the next frame is greater than a second threshold value $DBV_{th2}$ (S140). In an embodiment, the second threshold value $DBV_{th2}$ may be equal to the first threshold value $DBV_{th1}$. In another embodiment, the second threshold value $DBV_{th2}$ may be greater than the first threshold value $DBV_{th1}$.

When the luminance setting value DBV is greater than the second threshold value $DBV_{th2}$, the signal controller 150 controls the second power supply 140 so that the second power supply 140 may apply the power voltages ELVDD2 and ELVSS2 to the display unit 100 (S150). The signal controller 150 may output a control signal CONT4 to the second power supply 140, and the second power supply 140 may output the power voltages ELVDD2 and ELVSS2 to the display unit 100 in response to the control signal CONT4.

When a predetermined time elapses from the time when the second power supply 140 outputs the power voltages ELVDD2 and ELVSS2, the signal controller 150 controls the first power supply 130 to stop applying the power voltages ELVDD1 and ELVSS1 to the display unit 100.

In this instance, applying of the power voltages ELVDD2 and ELVSS2 by the second power supply 140 and stopping applying of the power voltages ELVDD1 and ELVSS1 by the first power supply 130 may be performed within the same frame.

The first threshold value $DBV_{th1}$ and the second threshold value $DBV_{th2}$ may be stored in the register of the signal controller 150. In the above, regarding the determination stages S110 and S140, "greater than" and "less than" may be substituted with "equal to or greater than" and "equal to or less than."

Timing for the power voltages ELVDD1, ELVSS1, ELVDD2, and ELVDD2 applied to the display unit 100 will now be described with reference to FIG. 4.

Figure 4:
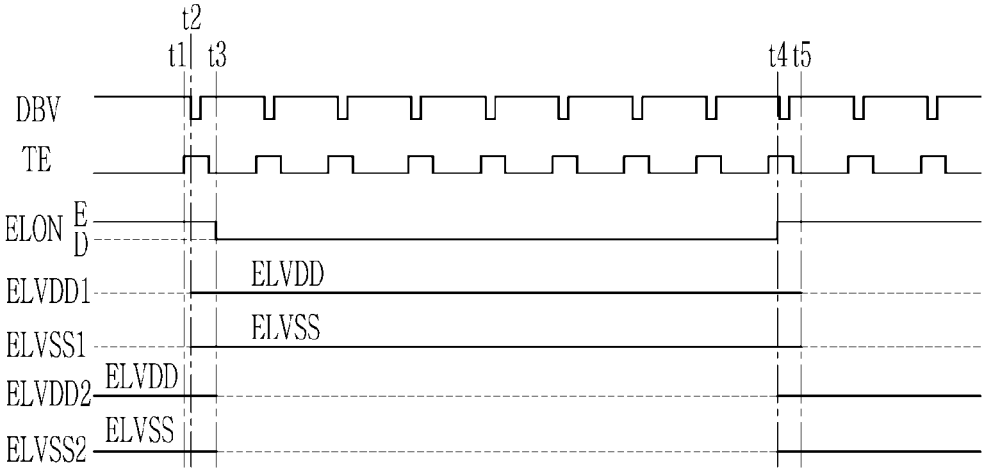
FIG. 4 is a timing diagram of representative signals to drive a display device according to an embodiment of the invention.

FIG. 4 is a timing diagram of representative signals to drive a display device according to an embodiment of the invention.

Referring to FIGS. 1 and 4, at the time of t1, a TE signal is input to the signal controller 150 from the application processor 160. At the time of t2, a luminance setting value DBV is input to the signal controller 150 from the application processor 160.

The signal controller 150 controls the first power supply 130 to apply power voltages ELVDD1 and ELVSS1 to the display unit 100 when the luminance setting value DBV is less than a first threshold value $DBV_{th1}$. Here, the supplying of the power voltages ELVDD2 and ELVSS2 by the second power supply 140 is maintained.

At the time of t3 when a predetermined time elapses from the time when the power voltages ELVDD1 and ELVSS1 are applied, the signal controller 150 outputs a control signal ELON, that is transitioned from an enable level E to a disable level D, to the second power supply 140 so that supplying of the power voltages ELVDD2 and ELVSS2 by the second power supply 140 may be stopped. As such, the signal controller 150 may control the second power supply 140 to maintain the power voltages ELVDD2 and ELVSS2 supplied to the display unit 100 for the predetermined time, and to stop supplying the power voltages ELVDD2 and ELVSS2 after the predetermined time. The control signal ELON may be included in the control signal CONT4 of FIG. 1.

During the predetermined time, the display unit 100 may change power voltages to be used by the pixels from the power voltages ELVDD2 and ELVSS2 to the power voltages ELVDD1 and ELVSS1. According to the illustrated embodiment, since power voltage supply periods by the first power supply 130 and the second power supply 140 overlap each other, time for changing the power voltages used by the pixels may be obtained beneficially as a result.

In each of subsequent frames in which the power voltages ELVDD1 and ELVSS1 are supplied to the display unit 100, the signal controller 150 may receive the luminance setting value DBV, and may compare the same with a second threshold value $DBV_{th2}$. That is, the signal controller 150 detects whether the luminance setting value DBV corresponding to the high luminance image is received when the power voltages ELVDD1 and ELVSS1 are applied by the first power supply 130. Each of the frames may be defined by a period in which the luminance setting value DBV or the TE signal toggles.

When the luminance setting value DBV received at the time of t4 is greater than a second threshold value $DBV_{th2}$, the signal controller 150 outputs the control signal ELON, that is transitioned from the disable level D to the enable level E, to the second power supply 140 so as to apply the power voltages ELVDD2 and ELVSS2 to the display unit 100. Here, supplying of the power voltages ELVDD1 and ELVSS1 by the first power supply 130 is maintained.

At the time of t5 when a predetermined time elapses from the time when the power voltages ELVDD2 and ELVSS2 are applied, the signal controller 150 may stop supplying of the power voltages ELVDD2 and ELVSS2 by the second power supply 140. As such, the signal controller 150 may control the first power supply 130 to maintain the power voltages ELVDD1 and ELVSS1 supplied to the display unit 100 for the predetermined time, and to stop supplying the power voltages ELVDD1 and ELVSS1 after the predetermined time.

According to the illustrated embodiment, since the power voltage supplying periods by the first power supply 130 and the second power supply 140 overlap each other, time for changing the power voltage used by the pixels may be obtained beneficially as a result.

An illustrative method for driving a display device according to another aspect of an embodiment will now be described with reference to FIG. 5 and FIG. 6.

Figure 5:
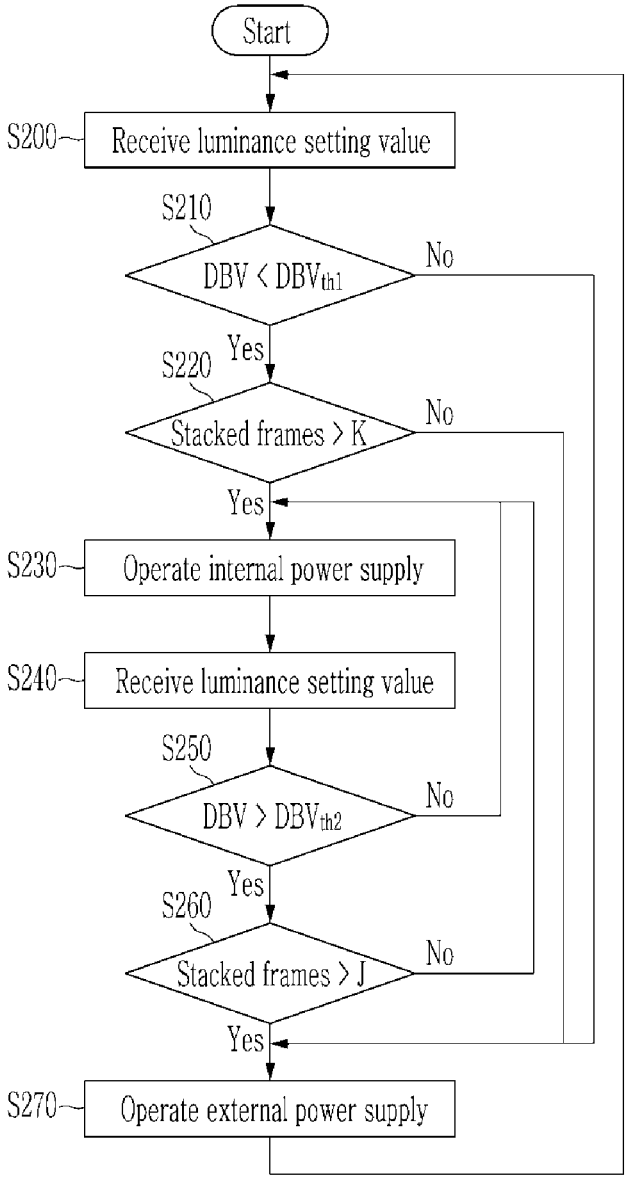
FIG. 5 is a flowchart of another embodiment of a method of driving a display device according to the principles of the invention.

FIG. 5 is a flowchart of another embodiment of a method of driving a display device according to the principles of the invention.

Referring to FIGS. 1 and 5, the signal controller 150 receives the luminance setting value DBV from the application processor 160 (S200).

The signal controller 150 determines whether the luminance setting value DBV is greater than a first threshold value $DBV_{th1}$ (S210).

When the luminance setting value DBV is less than the first threshold value $DBV_{th1}$, the signal controller 150 determines whether the number of successively stacked (or consecutive) frames of which the luminance setting value DBV is less than the first threshold value $DBV_{th1}$ is greater than a predetermined number K (S220).

When the number of successively stacked frames of which the luminance setting value DBV is less than the first threshold value $DBV_{th1}$ is greater than the predetermined number K, the signal controller 150 controls so that the first power supply 130 may apply the power voltages ELVDD1 and ELVSS1 to the display unit 100 (S230). The step S230 is performed if the luminance setting values DBV generated in the K consecutive frames are less than the first threshold value $DBV_{th1}$. The signal controller 150 may output the control signal CONT3 to the first power supply 130, and the first power supply 130 may output the power voltages ELVDD1 and ELVSS1 to the display unit 100 in response to the control signal CONT3.

When a predetermined time elapses from the time when the first power supply 130 outputs the power voltages ELVDD1 and ELVSS1, the signal controller 150 controls the second power supply 140 so that the second power supply 140 may not apply the power voltages ELVDD2 and ELVSS2 to the display unit 100.

In this instance, applying of the power voltages ELVDD1 and ELVSS1 by the first power supply 130 and stopping applying of the power voltages ELVDD2 and ELVSS2 by the second power supply 140 may be performed within the same frame.

The signal controller 150 receives the luminance setting value DBV of the next frame from the application processor 160 (S240).

The signal controller 150 determines whether the luminance setting value DBV of the next frame is greater than a second threshold value $DBV_{th2}$ (S250).

When the luminance setting value DBV is greater than the second threshold value $DBV_{th2}$, the signal controller 150 determines whether the number of successively stacked frames of which the luminance setting value DBV is greater than the second threshold value $DBV_{th2}$ is greater than a predetermined number J (here, it may be given that K=J, and K and J may be natural numbers that are different from each other) (S260).

When the number of successively stacked frames of which the luminance setting value DBV is greater than the second threshold value $DBV_{th2}$ is greater than the predetermined number J, the signal controller 150 controls so that the second power supply 140 may apply the power voltages ELVDD2 and ELVSS2 to the display unit 100 (S270). The step S270 is performed if, in the J consecutive frames in which the power voltages ELVDD1 and ELVSS1 are supplied to the display unit 100, the luminance setting values DBV are greater than the second threshold value $DBV_{th2}$. The signal controller 150 may output the control signal CONT4 to the second power supply 140, and the second power supply 140 may output the power voltages ELVDD2 and ELVSS2 to the display unit 100 in response to the control signal CONT4.

Further, when a predetermined time elapses from the time when the second power supply 140 outputs the power voltages ELVDD2 and ELVSS2, the signal controller 150 controls the first power supply 130 so that the first power supply 130 may not apply the power voltages ELVDD1 and ELVSS1 to the display unit 100.

In this instance, applying of the power voltages ELVDD2 and ELVSS2 by the second power supply 140 and stopping applying of the power voltages ELVDD1 and ELVSS1 by the first power supply 130 may be performed within the same frame.

The first threshold value $DBV_{th1}$ and the second threshold value $DBV_{th2}$ may be stored in the register of the signal controller 150. In the above, regarding the determination stages S210, S220, S250, and S260, "greater than" and "less than" may be substituted with "equal to or greater than" and "equal to or less than."

Timing for the power voltages ELVDD1, ELVSS1, ELVDD2, and ELVDD2 applied to the display unit 100 will now be described with reference to FIG. 6.

Figure 6:
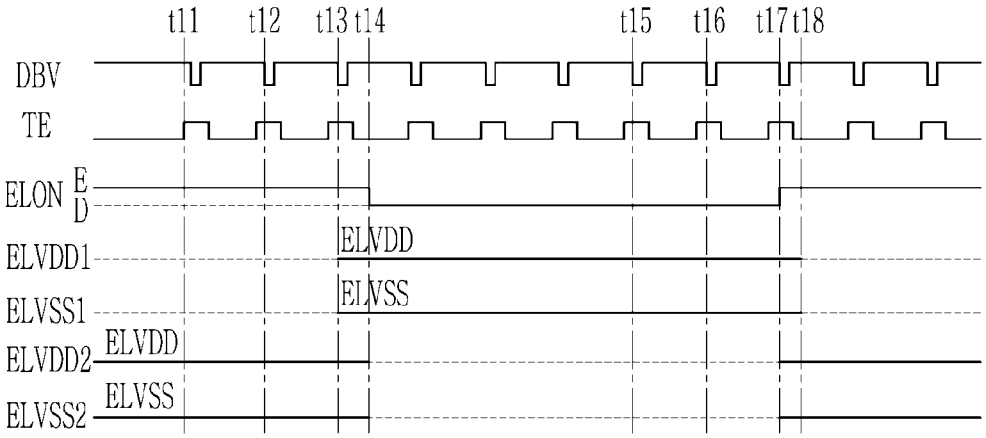
FIG. 6 is a timing diagram of representative signals to drive a display device according to another embodiment of the invention.

FIG. 6 is a timing diagram of representative signals to drive a display device according to another embodiment of the invention.

Referring to FIGS. 1 and 6, the luminance setting value DBV is input to the signal controller 150 from the application processor 160 in each of frames.

The luminance setting values DBV input at the time of t11, the time of t12, and the time of t13 are assumed to be less than a first threshold value DBVth1.

The number of successively stacked frames of which the luminance setting value DBV is less than the first threshold value $DBV_{th1}$ at the time of t11 is 1, the number thereof at the time of t12 is 2, and the number thereof at the time of t13 is 3.

When K is given as 2, the signal controller 150 controls the first power supply 130 at the time of t13 to apply the power voltages ELVDD1 and ELVSS1 to the display unit 100. The supply of the power voltages ELVDD2 and ELVSS2 by the second power supply 140 is maintained.

At the time of t14 when a predetermined time elapses from the time when the power voltages ELVDD1 and ELVSS1 are applied, the signal controller 150 outputs a control signal ELON, that is transitioned from an enable level E to a disable level D, to the second power supply 140 so that supplying of the power voltages ELVDD2 and ELVSS2 by the second power supply 140 may be stopped.

According to the illustrated embodiment, the power voltage supplying periods by the first power supply 130 and the second power supply 140 overlap each other, so time for changing the power voltage used by the pixels may be obtained beneficially as a result.

According to the illustrated embodiment, since the power voltage used by the pixels may be changed when the luminance setting values DBV are less than the first threshold value $DBV_{th1}$ in the consecutive frames, power consumption caused by control to change the power voltage may be reduced, and the display device 10 may be further stably driven.

In each of the subsequent frames, the signal controller 150 may receive the luminance setting value DBV and may compare the same with the second threshold value $DBV_{th2}$. That is, the signal controller 150 detects whether the luminance setting value DBV corresponding to the high-luminance image is received when the power voltages ELVDD1 and ELVSS1 by the first power supply 130 are applied.

The luminance setting values DBV input at the time of t15, the time of t16, and the time of t17 are assumed to be greater than the second threshold value $DBV_{th2}$.

The number of successively stacked frames of which the luminance setting value DBV is greater than the second threshold value $DBV_{th2}$ at the time of t15 is 1, the number thereof at the time of t16 is 2, and the number thereof at the time of t17 is 3.

When J is given as 2, the signal controller 150 outputs the control signal ELON, that is transitioned from the disable level D to an enable level E, to the second power supply 140 at the time of t17 so that the power voltages ELVDD2 and ELVSS2 may be applied to the display unit 100. Here, supplying of the power voltages ELVDD1 and ELVSS1 by the first power supply 130 is maintained.

The signal controller 150 may stop supplying of the power voltages ELVDD2 and ELVSS2 by the second power supply 140 at the time of t18 when a predetermined time elapses from the time when the power voltages ELVDD2 and ELVSS2 are applied.

According to the illustrated embodiment, the power voltage supplying periods by the first power supply 130 and the second power supply 140 overlap each other, so time for changing the power voltage used by the pixels may be obtained beneficially as a result.

According to the illustrated embodiment, since the power voltage used by the pixels may be changed when the luminance setting values DBV are greater than the second threshold value $DBV_{th2}$ in the consecutive frames, power consumption caused by control to change the power voltage may be reduced, and the display device 10 may be further stably driven.

An illustrative method for changing a power voltage by measuring a current load according to an embodiment will now be described with reference to FIG. 7 and FIG. 8.

Figure 7:
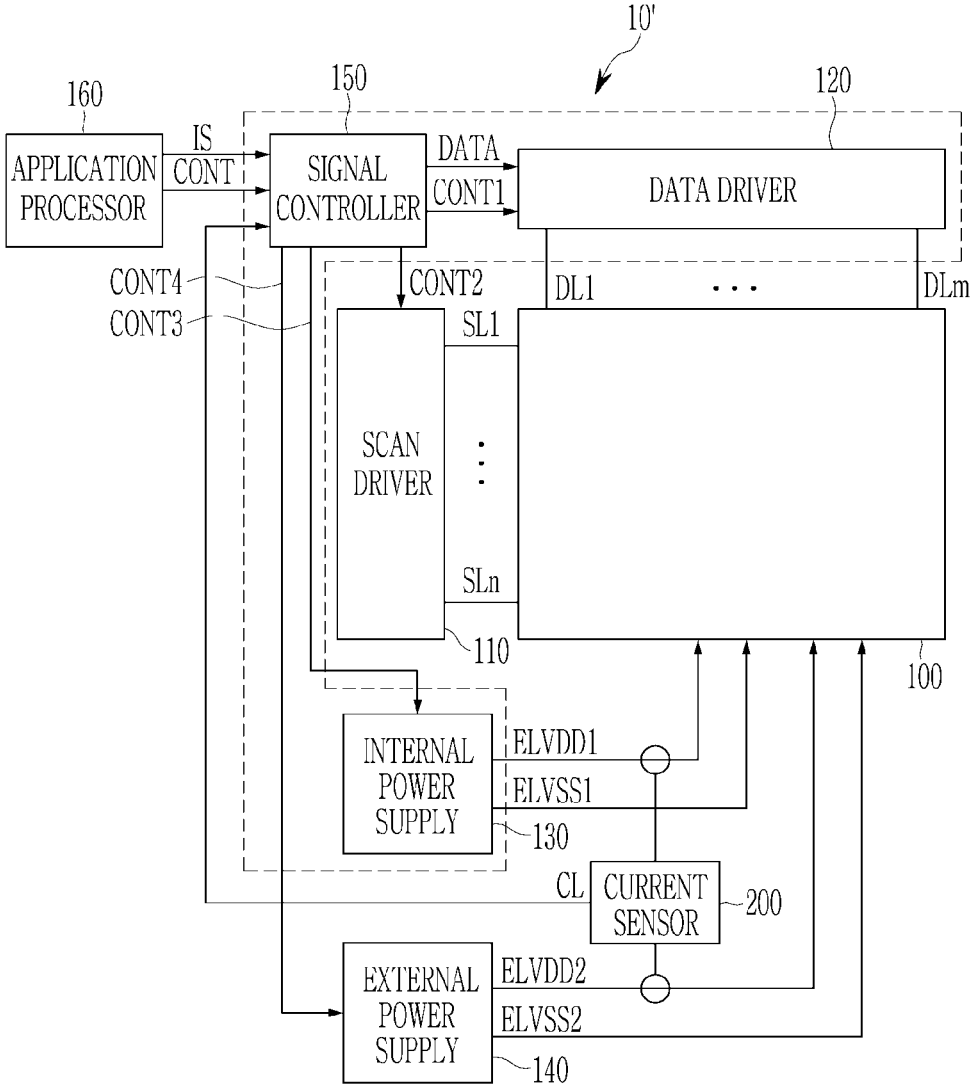
FIG. 7 is a block diagram of another embodiment of a display device constructed according to the principles of the invention.

FIG. 7 is a block diagram of another embodiment of a display device constructed according to the principles of the invention.

Descriptions of equivalent or similar elements as those described with reference to FIG. 1 above will be omitted to avoid redundancy.

Referring to FIG. 7, a display device 10' may further include a current sensor 200, compared to the display device 10 shown in FIG. 1.

The current sensor 200 may sense current flowing to the display unit 100 from the first power supply 130 and current flowing to the display unit 100 from the second power supply 140. In an embodiment, the current sensor 200 may sense current flowing through voltage supply lines that transmit the power voltages ELVDD1, ELVDD2, ELVSS1, and ELVSS2. The current flowing from the first power supply 130 and/or the second power supply 140 may be determined depending on the luminance of an image displayed by the display unit 100. For example, the current flowing from the first power supply 130 and/or the second power supply 140 may decrease when the display device 10' displays a low-luminance image. On the other hand, the current flowing from the first power supply 130 and/or the second power supply 140 may increase when the display device 10' displays a high-luminance image. The current sensor 200 transmits a current sensing value CL to the signal controller 150. The current sensing value CL may be indicative of the luminance of the image displayed by the display unit 100. For example, the current sensing value CL may be determined according to the higher of the current flowing from the first power supply 130 and the current flowing from the second power supply 140. For another example, the current sensing value CL may be determined according to the sum of the current flowing from the first power supply 130 and the current flowing from the second power supply 140.

The signal controller 150 may control the driving of the first power supply 130 and the second power supply 140 according to the current sensing value CL. The first power supply 130 and the second power supply 140 may supply the power voltages ELVDD1, ELVDD2, ELVSS1, and ELVSS2 for driving respective pixels. For example, the signal controller 150 may transmit the control signal CONT3 to the first power supply 130 so that the first power supply 130 may transmit the power voltages ELVDD1 and ELVSS1 to the display unit 100. Further, the signal controller 150 may transmit the control signal CONT4 to the second power supply 140 so that the second power supply 140 may transmit the power voltages ELVDD2 and ELVSS2 to the display unit 100. The first power supply 130 and the second power supply 140 may be connected to the voltage supply lines formed on the display unit 100. In addition, the first power supply 130 and the second power supply 140 may generate an additional voltage for driving pixels and may supply the same.

An illustrative method for driving a display device according to another embodiment will now be described with reference to FIG. 8.

Figure 8:
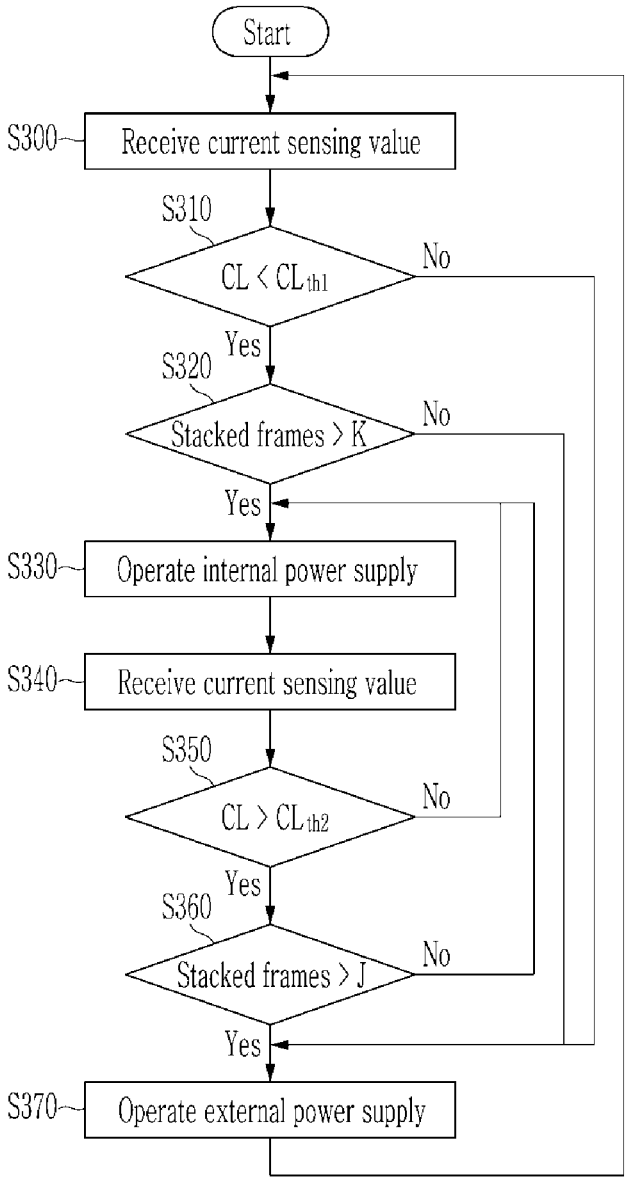
FIG. 8 is a flowchart of still another embodiment of a method of driving a display device according to the principles of the invention.

FIG. 8 is a flowchart of still another embodiment of a method of driving a display device according to the principles of the invention.

Referring to FIGS. 7 and 8, the signal controller 150 receives a current sensing value CL from the current sensor 200 (S300).

The signal controller 150 determines whether the current sensing value CL is less than a first threshold value $CL_{th1}$ (S310).

When the current sensing value CL is found to be less than the first threshold value $CL_{th1}$, the signal controller 150 determines whether the number of the successively stacked frames of which the current sensing value CL is less than the first threshold value $CL_{th1}$ is greater than a predetermined number K (S320). The predetermined number K may be an integer equal to or greater than 0.

When the number thereof is found to be greater than the predetermined number K, the signal controller 150 controls the first power supply 130 so that the first power supply 130 may apply the power voltages ELVDD1 and ELVSS1 to the display unit 100 (S330). The signal controller 150 may output a control signal CONT3 to first power supply 130, and the first power supply 130 may output the power voltages ELVDD1 and ELVSS1 to the display unit 100 in response to the control signal CONT3.

When a predetermined time elapses from the time when the first power supply 130 outputs the power voltages ELVDD1 and ELVSS1, the signal controller 150 controls the second power supply 140 so that the second power supply 140 may not apply the power voltages ELVDD2 and ELVSS2 to the display unit 100.

Here, applying of the power voltages ELVDD1 and ELVSS1 by the first power supply 130 and stopping applying of the power voltages ELVDD2 and ELVSS2 by the second power supply 140 may be performed within the same frame.

The signal controller 150 receives a current sensing value CL of the next frame from the application processor 160 (S340).

The signal controller 150 determines whether the current sensing value CL of the next frame is greater than a second threshold value $CL_{th2}$ (S350). In an embodiment, the second threshold value $CL_{th2}$ may be equal to the first threshold value $CL_{th1}$. In another embodiment, the second threshold value $CL_{th2}$ may be greater than the first threshold value $CL_{th1}$.

When the current sensing value CL is found to be greater than the second threshold value $CL_{th2}$, the signal controller 150 determines whether the number of successively stacked frames of which the current sensing value CL is greater than the second threshold value $CL_{th2}$ is greater than a predetermined number J (here, it may be that K=J, and K and J may be integers that are different from each other) (S360). The predetermined number J may be equal to or greater than 0.

When the number of successively stacked frames of which the current sensing value CL is greater than the second threshold value $CL_{th2}$ is found to be greater than the predetermined number J, the signal controller 150 controls the second power supply 140 so that the second power supply 140 may apply the power voltages ELVDD2 and ELVSS2 to the display unit 100 (S370). The signal controller 150 may output the control signal CONT4 to the second power supply 140, and the second power supply 140 may output the power voltages ELVDD2 and ELVSS2 to the display unit 100 in response to the control signal CONT4.

When a predetermined time elapses from the time when the second power supply 140 outputs the power voltages ELVDD2 and ELVSS2, the signal controller 150 controls the first power supply 130 so that the first power supply 130 may not apply the power voltages ELVDD1 and ELVSS1 to the display unit 100.

In this instance, applying of the power voltages ELVDD2 and ELVSS2 by the second power supply 140 and stopping applying of the power voltages ELVDD1 and ELVSS1 by the first power supply 130 may be performed within the same frame.

According to the illustrated embodiment, since the power voltage used by the pixels may be changed when the current sensing values CL are less than the first threshold value $CL_{th1}$ in the consecutive frames, power consumption caused by control to change the power voltage may be reduced, and the display device 10' may be further stably driven.

If low-luminance images are displayed for one or more consecutive frames, it may be expected to display a low-luminance image in the next frame.

Therefore, power consumption may be reduced by monitoring the luminance of the image to be displayed by the display unit 100 and controlling one of the first power supply 130 and the second power supply 140 accordingly to supply the power voltage to the display unit 100. Given that the current sensing value CL reflects the luminance of the image displayed by the display unit 100, the signal controller 150 may select one of the first power supply 130 and the second power supply 140 based on the current sensing value CL and may control the selected power supply to generate the power voltage to be used by the display unit 100 in the next frame, thereby reducing the power consumption.

The above-described first threshold value $CL_{th1}$ and the second threshold value $CL_{th2}$ may be stored in the register of the signal controller 150. In the above, regarding the determination stages S310 and S350, "greater than" and "less than" may be substituted with "equal to or greater than" and "equal to or less than."

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a display unit including a plurality of pixels to display an image;

a first power supply to generate a first power voltage including a first high level power voltage and a first low level power voltage;

a second power supply to generate a second power voltage including a second high level power voltage and a second low level power voltage; and a signal controller to control the first power supply to supply the first power voltage to the display unit in response to at least one control signal associated with luminance of the image, and to control the second power supply to supply the second power voltage to the display unit in response to the control signal being activated for a first period of time after the first power voltage starts to be supplied to the display unit, and to control the first power supply to stop supplying the first power voltage after the second power voltage starts to be supplied, wherein the first high level power voltage has a level lower than a level of the second high level power voltage, and the first low level power voltage has a level higher than a level of the second low level power voltage; and wherein the first high level power voltage, the second high level power voltage, the first low level power voltage, and the second low level power voltage are applied simultaneously during the first period of time.

2. The display device of claim 1, wherein the control signal comprises a luminance setting value; and the signal controller is configured to receive the luminance setting value from an application processor and to control the first power supply to supply the first power voltage in response to the luminance setting value being less than a first threshold value.

3. The display device of claim 1, wherein:

the control signal comprises a luminance setting value; and the signal controller is configured to receive the luminance setting value from an application processor and to control the second power supply to supply the second power voltage in response to the luminance setting value being greater than a second threshold value.

4. The display device of claim 1, wherein:

the at least one control signal comprises first control signals generated in consecutive first frame periods; and the signal controller is configured to control the first power supply to supply the first power voltage to the display unit in response to the first control signals being less than a first threshold value.

5. The display device of claim 4, wherein:

the at least one control signal comprises second control signals generated in consecutive second frame periods in which the first power voltage is supplied to the display unit; and the signal controller is configured to control the second power supply to supply the second power voltage to the display unit in response to the second control signals being greater than a second threshold value, and to control the first power supply to stop supplying the first power voltage after the second power voltage starts to be supplied.

6. The display device of claim 1, further comprising a current sensor to generate a current sensing value by sensing at least one of current flowing to the display unit from the first power supply and current flowing to the display unit from the second power supply, wherein the signal controller is configured to receive the current sensing value as the control signal in at least one frame period, and to control the first power supply to supply the first power voltage in response to the current sensing value being less than a first threshold value.

7. The display device of claim 1, wherein:

the first power supply comprises a charge pump, and the second power supply comprises a DC-DC converter.

8. The display device of claim 1, further comprising a data driver to generate data signals based on image data and to output the data signals to the display unit through a plurality of data lines connected to the pixels, wherein the signal controller, the first power supply, and the data driver are integrated into an IC chip.

9. The display device of claim 1, wherein:

the signal controller is configured to control the first power supply to supply the first power voltage to the display unit in response to the control signal when the second power voltage is supplied to the display unit.

10. The display device of claim 1, wherein the signal controller is configured to control the second power supply to maintain the second power voltage supplied to the display unit for a predetermined period of time after the first power voltage starts to be supplied, and to stop supplying the second power voltage after the predetermined period of time elapses.

11. A method of driving a display device having a display unit to display an image, the method comprising the steps of:

receiving at least one control signal associated with luminance of the image;

supplying a first power voltage including a first high level power voltage and a first low level power voltage to the display unit in response to the control signal when a second power voltage including a second high level power voltage and a second low level power voltage is supplied to the display unit;

continuing to supply the second power voltage to the display unit for a first period of time after the first power voltage starts to be supplied; and stopping supplying the second power voltage after the first period of time elapses, wherein the first high level power voltage has a level lower than a level of the second high level power voltage, and the first low level power voltage has a level higher than a level of the second low level power voltage; and wherein the first high level power voltage, the second high level power voltage, the first low level power voltage, and the second low level power voltage are applied simultaneously during the first period of time.

12. The method of claim 11, wherein:

the control signal comprises a luminance setting value;

the luminance setting value is received from an application; and the step of supplying the first power voltage comprises supplying the first power voltage to the display unit in response to the luminance setting value being less than a first threshold value.

13. The method of claim 11, further comprising the steps of:

supplying the second power voltage to the display unit in response to the control signal when the first power voltage is supplied to the display unit;

maintaining the first power voltage supplied to the display unit for a second period of time after the second power voltage starts to be supplied; and stopping supplying the first power voltage after the second period of time elapses.

14. The method of claim 13, wherein:

the control signal comprises a luminance setting value;

the luminance setting value is received from an application processor; and the step of supplying the second power voltage comprises supplying the second power voltage to the display unit in response to the luminance setting value being greater than a second threshold value.

15. The method of claim 11, wherein:

the at least one control signal comprises first control signals generated in consecutive first frame periods; and the step of supplying the first power voltage comprises supplying the first power voltage to the display unit in response to the first control signals being less than a first threshold value.

16. The method of claim 15, wherein:

the at least one control signal comprises second control signals generated in consecutive second frame periods in which the first power voltage is supplied to the display unit; and further comprising the steps of:

supplying the second power voltage to the display unit in response to the second control signals being greater than a second threshold value;

maintaining the first power voltage supplied to the display unit for a second period of time after the second power voltage starts to be supplied; and stopping supplying the first power voltage after the second period of time elapses.

17. The method of claim 11, further comprising the step of:

generating a current sensing value by sensing current for the first power voltage supplied to the display unit and sensing current for the second power voltage supplied to the display unit, wherein:

the at least one control signal comprises the current sensing value generated in at least one frame period, and the step of supplying the first power voltage comprises supplying the first power voltage to the display unit in response to the current sensing value being less than a threshold value.

18. The method of claim 11, wherein:

the first high level power voltage has a level lower than a level of the second high level power voltage;

the first low level power voltage has a level higher than a level of the second low level power voltage; and the step of supplying the first power voltage comprises supplying the first power voltage to the display unit in response to the control signal being less than a threshold voltage.

19. A display device comprising:

a display unit disposed on a substrate and including a plurality of pixels to display an image;

a scan driver disposed on the substrate to output a scan signal to a plurality of scan lines connected to the pixels;

a data driver to generate data signals based on image data received from an application processor and to output the data signals to the display unit through a plurality of data lines connected to the pixels;

a charge pump to generate a first power voltage including a first high level power voltage and a first low level power voltage for the display unit;

a DC-DC converter to generate a second power voltage including a second high level power voltage and a second low level power voltage for the display unit; and a signal controller to control the charge pump to supply the first power voltage to the display unit in response to at least one control signal associated with luminance of the image, and to control the DC-DC converter to supply the second power voltage to the display unit in response to the control signal being activated for a first period of time after the first power voltage starts to be supplied to the display unit, and to control the first power supply to stop supplying the first power voltage after the second power voltage starts to be supplied, wherein the data driver, the charge pump, and the signal controller are disposed in an IC chip, wherein the first high level power voltage has a level lower than a level of the second high level power voltage, and the first low level power voltage has a level higher than a level of the second low level power voltage; and wherein the first high level power voltage, the second high level power voltage, the first low level power voltage, and the second low level power voltage are applied simultaneously during the first period of time.

* * * * *